US005164694A

United States Patent [19]

DeVault et al.

[11] Patent Number: 5,164,694

[45] Date of Patent: Nov. 17, 1992

[54] MECHANICAL INTERLOCK FOR A PAIR OF ELECTROMAGNETIC SWITCHES

[75] Inventors: Birch L. DeVault, Arden; Glenn H. Edwards, Leicester, both of N.C.

[73] Assignee: Westinghouse Electric Corp., Pittsburgh, Pa.

[21] Appl. No.: 691,186

[22] Filed: Apr. 25, 1991

[51] Int. Cl.[5] ..... H01H 67/02

[52] U.S. Cl. ..... 335/132; 200/50 C

[58] Field of Search ..... 200/50 AA-50 C; 335/8-10, 132

[56] References Cited

U.S. PATENT DOCUMENTS

| | | | |
|---|---|---|---|
| 2,756,612 | 7/1956 | Schleicher | 200/50 C |
| 3,815,063 | 6/1974 | Grunert et al. . | |
| 4,590,387 | 5/1986 | Yoshida et al. | 200/50 C |

OTHER PUBLICATIONS

I. L. 14592, File 17-900 Instructions for Mechanical Interlock for Definite Purpose Contactors, effective Dec. 1972.

*Primary Examiner*—Lincoln Donovan

*Attorney, Agent, or Firm*—M. J. Moran

[57] ABSTRACT

An interlock, for a pair of electromagnetic switches, includes operating members which are pivoted by movement of armatures of the switches between off and on positions. Ring segment cams are carried by the respective operating members along arcuate paths which intersect such that movement of one switch out of the off position mechanically blocks movement of the armature of the other switch out of the off position. For side by side electromagnetic switches, the operating members are directly confronting. For other arrangements of the switches, such as one above the other, the operating member of one switch includes a first pivot member pivoted by the associated armature, and a second pivot member on which the ring segment cam is carried, confronting the second operating member, and connected to and pivoted with the first pivot member by a connecting member.

18 Claims, 4 Drawing Sheets

MECHANICAL INTERLOCK FOR A PAIR OF ELECTROMAGNETIC SWITCHES

BACKGROUND OF THE INVENTION

1. Field of the Invention

This invention relates to an interlock for mechanically preventing two electromagnetic switches from being turned on at the same time, and has particular application to forward and reverse controllers for electric motors.

2. Background Information

There are applications were two electromagnetic switches must not be energized at the same time. One such application involves the forward and reverse controllers for electric motors. Simultaneous operation of both controllers would result in short circuiting of the phases of the power supply.

There are a variety of mechanical interlock designs in use today for preventing the simultaneous energization of two controllers. Probably the most common type of mechanical interlock is the "see saw" design. This type of interlock relies on the high closed gap force of an electromagnet compared to the open gap force to prevent the closure of the second controller. However, it is possible to cause a transition from a primary controller to a secondary controller by the application of an external mechanical force. Also, the linear nature of this design results in substantial travel of both controllers before interlocking action begins. Another common mechanical interlock is based on using a "four bar" linkage. An example of such an interlock is disclosed in U.S. Pat. No. 3,815,063. The "four bar" design eliminates the long pretravel of the "see saw" design, but a transition from a primary controller to a secondary controller can still be forced mechanically.

There is a need for an improved mechanical interlock for a pair of electromagnetic switches.

There remains a need for a mechanical interlock for a pair of electromagnetic switches which can not be overridden by application of a mechanical force.

There is also a need for such an improved mechanical interlock which provides the interlock function with minimum travel of the switch armatures.

There is a continued need for such mechanical interlocks which are rugged, reliable, and economical to manufacture and retrofit to existing electromagnetic switches.

There is a particular need for such an improved interlock adapted for interlocking forward and reverse motors controllers.

SUMMARY OF THE INVENTION

These and other needs are satisfied by the invention which is directed to a mechanical interlock for a pair of electromagnetic switches, such as forward and reverse motor controllers, which includes operating members for each of the switches which are pivoted by movement of the armature of the respective switch between open and closed positions. Cams are carried along arcuate paths by the pivoting of each of the operating members. The arcuate paths along which the cams are carried intersect at intersection point located such that when one of the switches is out of the off position the associated cam is pivoted to extend through the intersection point, thereby mechanically blocking pivoting of the other cam, and therefore the associated switch armature, out of the off position. The intersection point of the arcuate paths along which the cams travel is spaced adjacent one end of each of the cams only by a distance providing clearance for one cam only to be carried along its arcuate path without interference from the other cam. In the preferred embodiment of the invention, the cams are ring segments aligned with the respective arcuate paths.

In one embodiment of the invention, adapted for use with electromagnetic switches which are positioned side by side with their armature aligned for movement in a common plane, the two operating members of the interlock confront one another with the respective cams projecting toward the other operating members so that the arcuate paths followed by the cams are in a common plane.

In another embodiment of the invention where the electromagnetic switches are positioned with their armatures spaced apart for movement in parallel planes, one operating member comprises a first pivot member pivoted by movement of the armature of the associated switch, a second pivot member confronting the operating member of the other switch and a connecting member connecting the second pivot member to the first pivot member for pivoting the second pivot member with movement of the first armature. The second pivot member carries the cam for the one operating member along the arcuate path which intersects the arcuate path of the cam carried by the other operating member.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The invention will be described as applied to a forward and reverse motor controller pair; however, it will be realized that the invention has application to switches for other applications.

Figure 1:
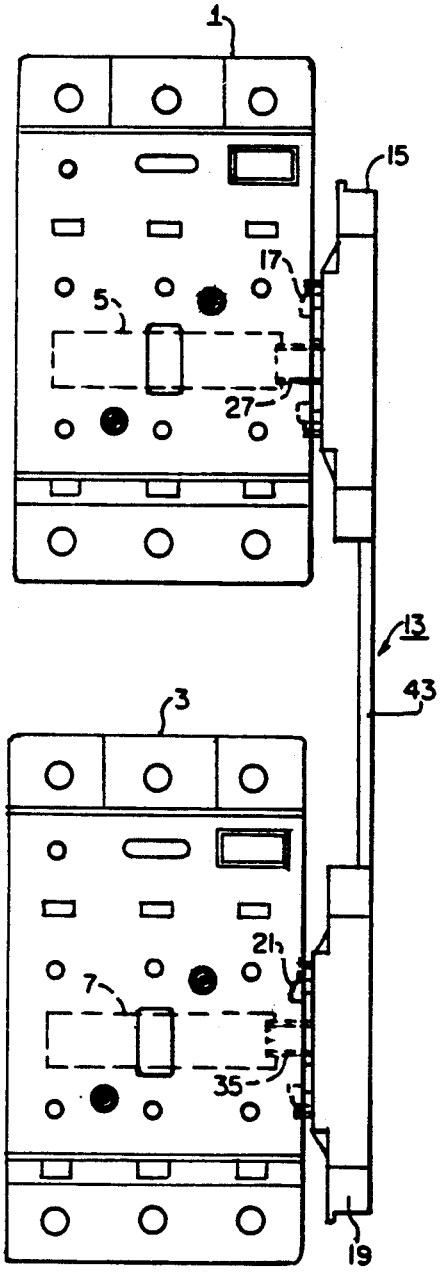
FIG. 1 is a front elevation view of a pair of motor controllers interlocked in accordance with the invention.
Figure 2:
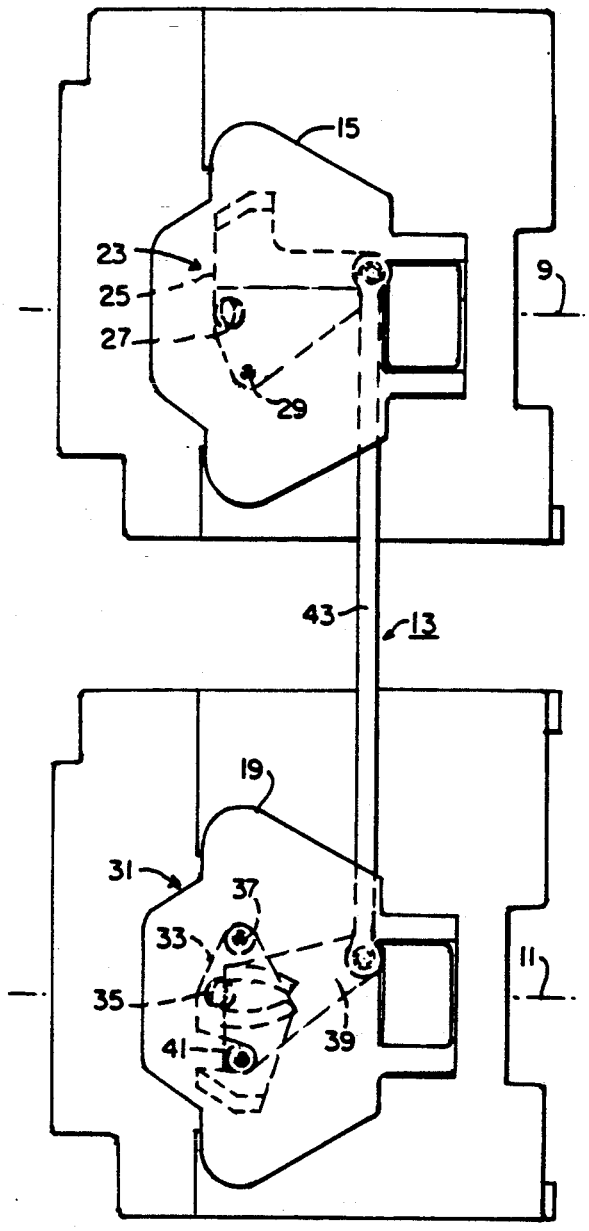
FIG. 2 is a side elevation view of the interlocked controllers shown in FIG. 1.

Referring to FIGS. 1 and 2, a forward motor controller 1 is shown mounted in direct alignment above a reverse motor controller 3. The controllers 1 and 3 have armatures 5 and 7, respectively, which move in horizontal planes 9 and 11.

An interlock device 13 is provided in accordance with the invention to prevent simultaneous closure of the two controllers 1 and 3. The interlock device 13 includes an upper housing 15 secured to the side of circuit controller 1 by a pair of locking jaws 17 and a lower housing 19 similarly secured to the side of controller 3 by locking jaws 21.

Referring to FIGS. 3 through 6, as well as 1 and 2, the upper housing 15 contains an upper operating member 23 which includes a first pivot member 25. Extending laterally from the pivot member 25 and into engagement with the armature 5 of the controller 1 is a shaft 27. As the armature moves forward and backward between an open and closed position, respectively, the shaft 27 rotates the first pivot member about a pivot pin 29.

The lower housing 19 supports a second operating member 31 which includes a pivot member 33 having a shaft 35 extending into and engaging the armature 7 of the controller 3 and pivoted about a pivot pin 37.

The first operating member 23 includes a second pivot member 39 mounted in the lower housing 19 for rotation about a pivot pin 41. The second pivot member 39 is connected to the first pivot member 25 by a connecting rod 43 such that rotation of the first pivot member 25 causes corresponding rotation of the second pivot member 39. The pivot member 33 of the lower operating member 31 has a slot 45 which provides clearance for the pivot member 33 relative to the pivot 41. The pivot members 33 and 39 are mounted in a confronting relation with their pivot pins 37 and 41 mounted equidistantly above and below, respectively, the plane of movement of the armature 7 of the lower controller 3. The pivot member 33 has a cam in the form of a ring segment 47 which projects laterally toward the pivot member 39 and is carried along an arcuate path 49 with pivoting of the pivot member 33.

Similarly, a cam in the form of ring segment 51 extends laterally from a pivot member 39 toward the pivot member 33 and is carried along an arcuate path 53 with pivoting of the pivot member 39. The ring segment cams 47 and 51 are in the same plane such that the arcuate paths 49 and 53 intersect at an intersection point 55. The centers of curvature of the ring segment cams 47 and 51 are coincident with the pivot pins 37 and 41, respectively.

Figure 5:
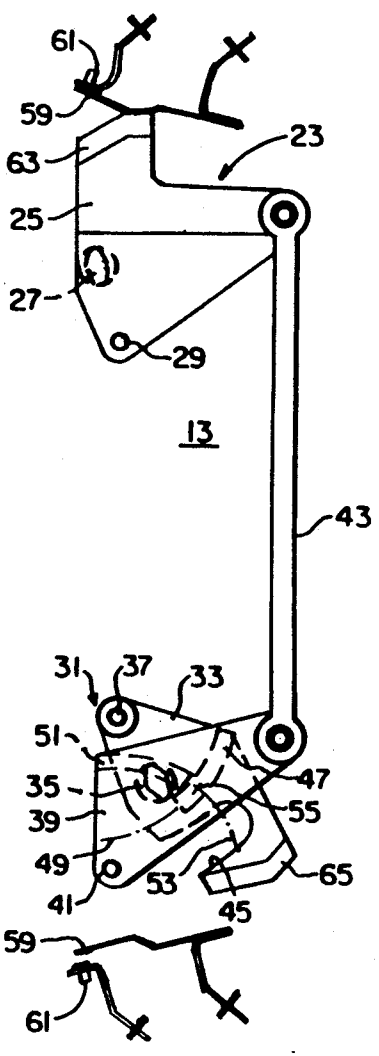
FIG. 5 is an elevation view similar to FIG. 4 showing the configuration of the interlock with the lower controller in the closed position.
Figure 4:
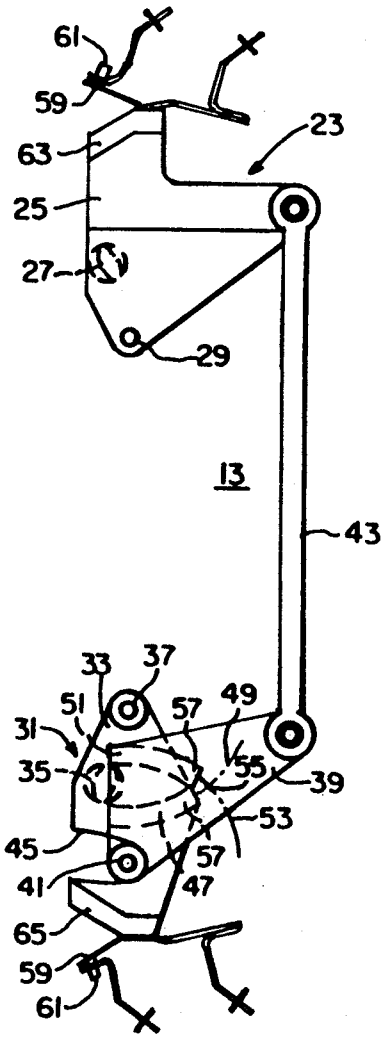
FIG. 4 is a side elevation view of the interlock of FIG. 3 shown in the rest position with both of the interlocked controllers open.
Figure 3:
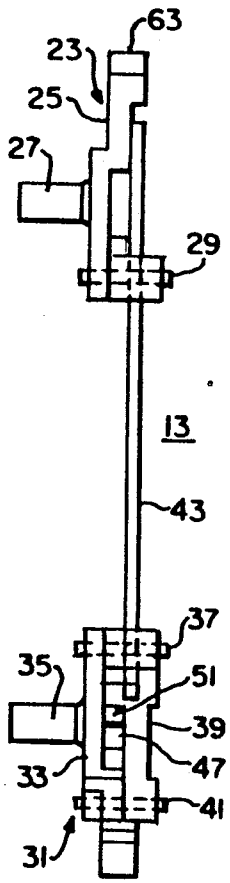
FIG. 3 is a front elevation view of the operating components of the interlock utilized in FIGS. 1 and 2.

With both of the controllers 1 and 3 "open" the interlock mechanism is in the condition shown in FIG. 4 in which neither of the cams 47 or 51 extend through the intersection point 55 of their arcuate paths. If the lower or reverse controller 3 is energized causing the armature 7 to move rearward, the pivot member 33 of the lower operating member 31 is rotated counter-clockwise as shown in FIG. 5 by the shaft 35. This carries the cam 47 along the arcuate path 49 so that it extends through the intersection point 55 as shown in FIG. 5. With the cam 47 in this position, the upper controller 1 cannot be energized because the pivot member 39 cannot be rotated due to interference by the cam 47 and, thus, the armature 5 of the controller 1 cannot be moved because of its rigid interconnection with the pivot member 39 through the shaft 27, first pivot member 25, and the connecting the rod 43.

Figure 6:
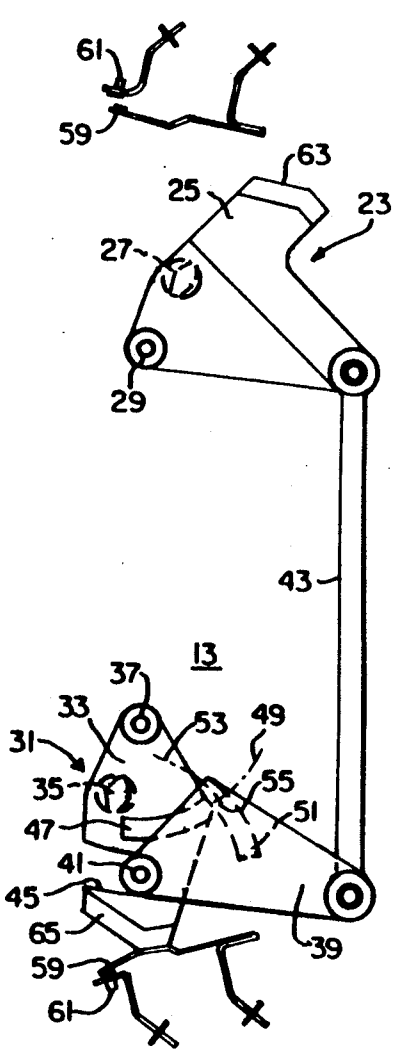
FIG. 6 is a view similar to FIG. 4 showing the configuration of the interlock with the upper controller in the closed position.

If, on the other hand, with both controllers "open" as shown in FIG. 4, the upper controller 1 is energized thereby drawing its armature 5 toward the rear, the shaft 27 rotates the pivot member 25 which in turn rotates the pivot member 39 through the connecting rod 43 to carry the ring segment cam 51 along its arcuate path 53 to the position shown in FIG. 6 in which it extends through the intersection point 55. This blocks rotation of the pivot member 33 so that the lower controller 3 cannot be closed as long as the upper controller 1 is not open.

It should be noted that the cams 47 and 51 are positioned when the respective switches are "open" with one end 57 spaced from the intersection point 55 only by a clearance necessary to prevent interference with the other cam. Thus, initial movement of the armature of either controller is sufficient to block operation of the other controller. Hence, unlike prior art interlocks, very little travel of the armature of the first controller to be energized is required to provide the interlock function. In addition, the mechanical interference effected by this interlock prevents manual override through application of a mechanical force to the armature of the second controller.

The interlock device of the invention also includes switches which can be used to perform an electrical interlock function. Cantilevered movable spring contacts 59 are deflected into electrical contact with fixed contacts 61 by auxiliary camming surfaces 63 and 65 on the pivot members 25 and 33, respectively, when the associated controller is "open".

Figure 7:
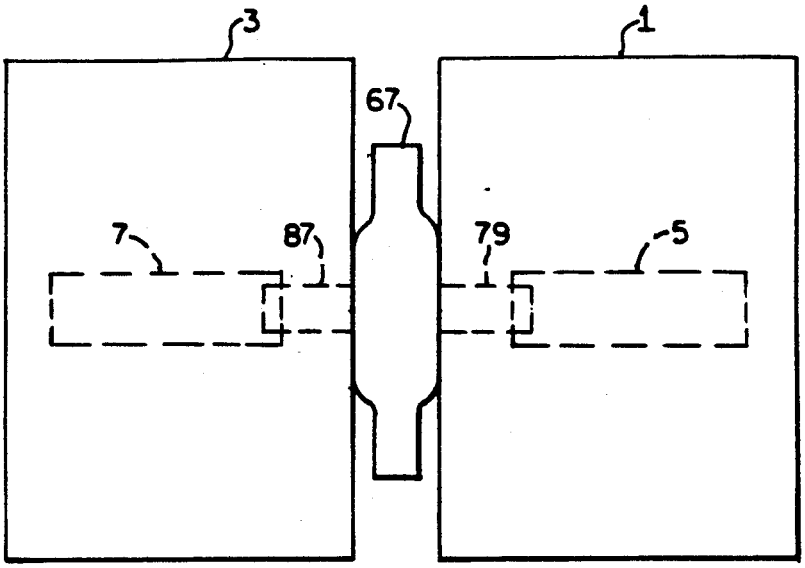
FIG. 7 is a front elevation view of two controllers mounted side by side and interlocked with another embodiment of the invention.
Figure 8:
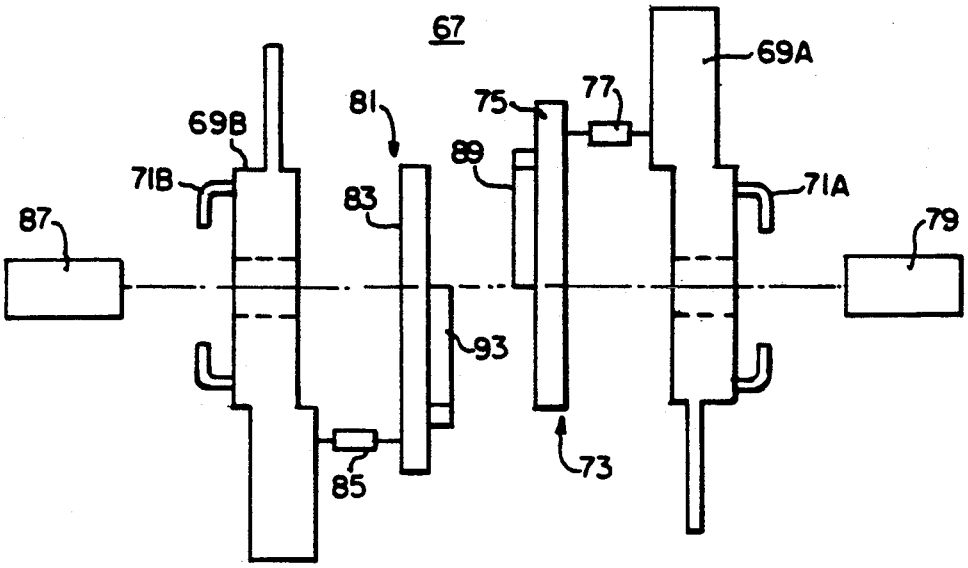
FIG. 8 is an exploded front elevation view of the interlock of FIG. 7.

FIGS. 7 through 10 illustrate a second embodiment of the invention which is adapted for use with a pair of controllers 1 and 3 mounted side by side for movement of their armatures 5 and 7 in a common plane perpendicular to the plane of FIG. 7. The interlock 67 includes a single housing having housing halves 69A and 69B, best seen in the exploded view of FIG. 8. The housing 69 is secured to the controllers 1 and 3 by pairs of jaws 71A and B, respectively. A first operating member 73 includes a pivot member 75 which is pivoted for a movement within the housing 69 about a pivot pin 77. Extending outward from the pivot member 75 through the housing section 69A and into engagement with the armature 5 of the controller 1 is a shaft 79.

The interlock 67 includes a second operating member 81 comprising a pivot member 83 pivoted in the housing about a pivot pin 85 and having a shaft 87 which extends through the housing section 69B and into the controller 3 to engage the armature 7. A ring segment cam 89 on the pivot member 73 is carried along a arcuate path 91 by pivoting of the pivot member 73 by the armature 5 of the controller 1 through the shaft 79. Similarly, a ring-shaped cam 93 on the pivot member 83 is carried along arcuate path 95 by movement of the armature 7 of the controller 3. The pivot members 75 and 83 are mounted in the housing 69 in confronting relation with the cams 89 and 93 extending toward the other pivot member so that the arcuate paths 91 and 95 are coplanar and intersect at a point 97.

Figure 9:
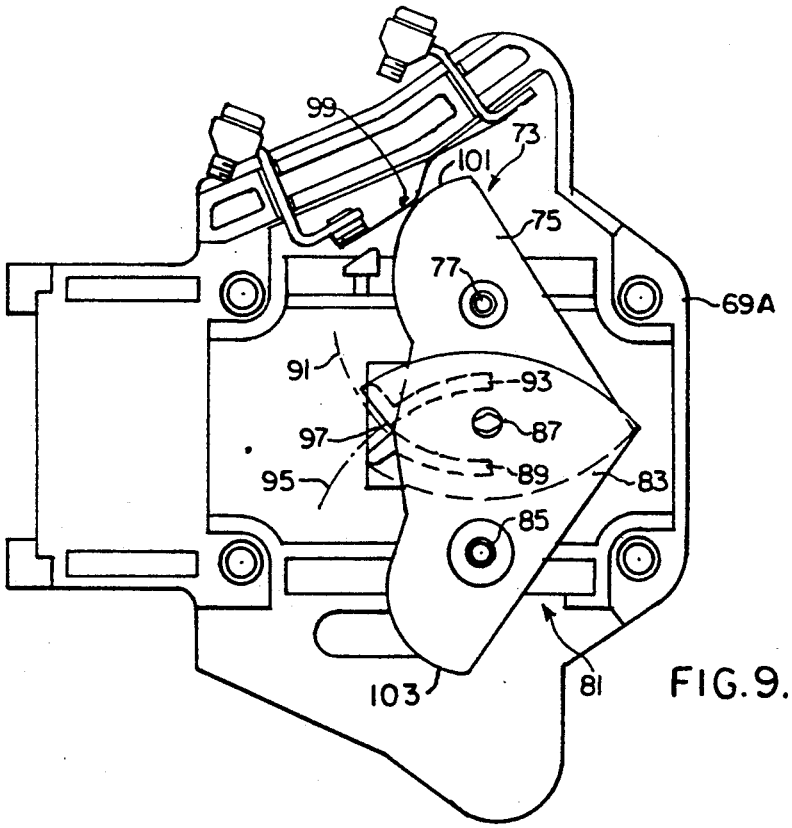
FIG. 9 is a vertical view with one half of the housing removed on the interlock of FIG. 8 shown with both controllers open.
Figure 10:
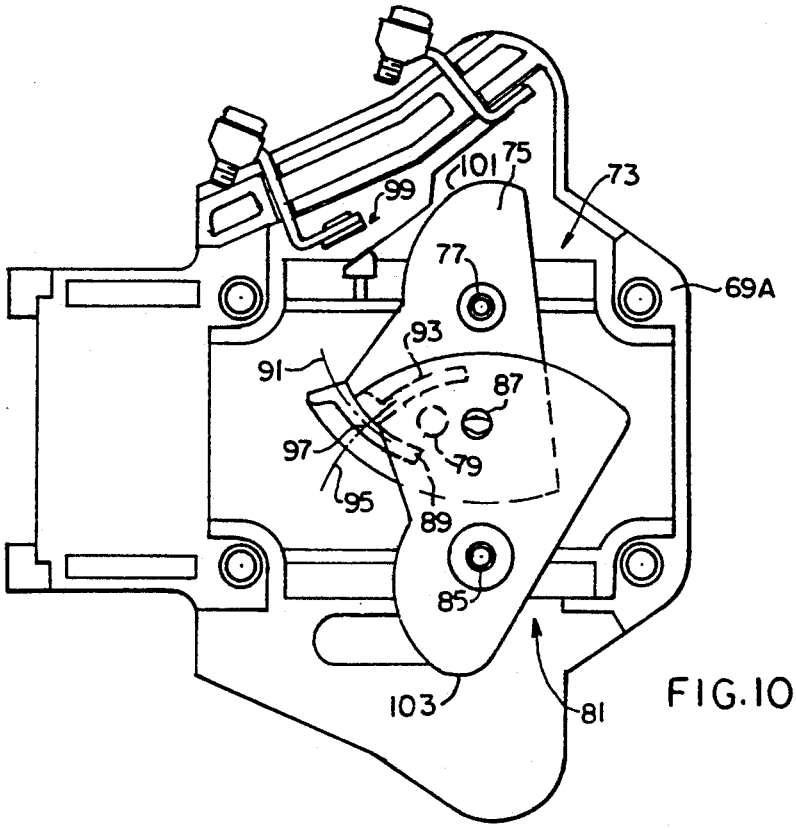
FIG. 10 is a view similar to FIG. 9 showing the configuration of the interlock with one switch closed.

FIG. 9 illustrates the position of the operating members 73 and 81 when both of the controllers 1 and 3 are open. In this position, neither of the cams 89 or 93 extend through the intersection point 97 of the arcuate paths 91 and 95. FIG. 10 illustrates the condition where the controller 1 has been energized which causes rotation of the pivot member 75 of the operating member 73 to carry the cam 89 along the arcuate path 91 so that it extends through the intersection point 97. In this position, the cam 89 blocks rotation of the pivot member 83 to prevent movement of the armature 7 to close the controller 3. It can be appreciated that, if instead, with both controllers off as shown in FIG. 9, closing of the controller 3 will result in rotation of the pivot member 83 so that its cam 93 would extend through the intersection point 97 thereby mechanically blocking closing of the controller 1.

The interlock 67 also include switches 99 which are closed by auxiliary cam surfaces 101, 103 on the pivot members 75 and 83 to a closed position when the respective controllers 1 and 3 are open.

As previously discussed, the intersection point 97 of the arcuate paths 91 and 95 is spaced from the ends of the cams 89 and 93 when the respective controllers are in the open position, only by a distance required for clearance for the other cam, so that very little travel of the armature of one of the switches is required to effect the interlock.

Interlocks in accordance with the invention provide a simple, positive, mechanical interlock which operates with a minimum of armature travel and cannot be overridden by application of a mechanical force to the armature of one of the controllers.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An interlock for two spaced apart electromagnetic switches each having an armature which moves between open and closed positions to open and close the electromagnetic switch, said interlock comprising:

a first operating member pivoted by movement of the armature of said first switch between said open and closed positions;

a second operating member pivoted by movement of the armature of said second switch between said open and closed positions;

first cam means carried along a first arcuate path by said pivoting of said first operating member; and second cam means carried along a second arcuate path by said pivoting of said second operating member, said arcuate paths intersecting at an intersection point through which neither cam means extends when both electromagnetic switches are open, and through which extends one cam means carried by the pivoting of one operating member by movement of the armature of one switch out of the open position to block the other cam means thereby preventing movement of the armature of the other electromagnetic switch out of the open position.

2. The interlock of claim 1 wherein each of said cam means has one end adjacent said intersection point and spaced therefrom only by a distance providing clearance for one cam means only to be carried along its arcuate path without interference from the other cam means.

3. The interlock of claim 2 wherein said first and second cam means each comprise a ring segment aligned with said first and second arcuate paths, respectively.

4. The interlock of claim 1 wherein said first and second electromagnetic switches are positioned side by side with said armatures aligned for movement in a common plane with said first and second operating members confronting one another and wherein said first and second arcuate paths are coplanar.

5. The interlock of claim 4 wherein said first operating member is pivoted about a first pivot axis on one side of said common plane, and said second operating member is pivoted about a second pivot axis on an opposite side of said common plane.

6. The interlock of claim 5 wherein said first cam means comprises a first ring segment on said first operating member having a center of curvature coincident with said first pivot axis, and wherein said second cam comprises a second ring segment on said second operating member having a center of curvature coincident with said second pivot axis.

7. The interlock of claim 6 including a common housing with said first and second operating members pivotally mounted within said common housing.

8. The interlock of claim 1 where in said electromagnetic switches are positioned with the first and second armatures spaced apart for movement in parallel planes, and wherein said first operating member comprises a first pivot member pivoted by movement of the armature of said first switch between said open and closed positions, a second pivot member confronting said second operating member, and a connecting member connecting said second pivot member to said first pivot member for pivoting said second pivot member with movement of said first armature between said open and closed positions, wherein said first and second arcuate paths being coplanar.

9. The interlock of claim 8 wherein said second operating member is pivoted about a first pivot axis on one side of the plane of movement of the second armature, and the second pivot member is pivoted about a second pivot axis on the opposite side of said plane in which said second armature moves.

10. The interlock of claim 9 wherein said first cam means comprises a first ring segment on said second pivot member having a center of curvature coincident with said second pivot axis, and wherein said second cam means comprises a second ring segment on the second operating member and having a center of curvature coincident with said first pivot axis.

11. The interlock of claim 10 including a common housing in which said second operating member and second pivot member are pivotally mounted.

12. In combination;

first and second electromagnetic switches positioned side by side and each having an armature movable in a common plane between open and closed positions which open and close said electromagnetic switch;

a housing;

a first operating member engaging said armature of said first switch and pivotally mounted in said housing for pivoting about a first pivot axis on one side of said common plane;

a second operating member engaging said armature of said second switch and pivotally mounted in said housing in confronting relationship with said first operating member for pivoting about a second pivot axis on an opposite side of said common plane;

a first cam on said first operating member extending toward said second operating member and carried by said first operating member along a first arcuate path; and a second cam on said second operating member extending toward said first operating member and carried by said first operating member along a second arcuate path said arcuate paths being coplanar and intersecting at an intersection point through which neither cam extends when both electromagnetic switches are open, and through which extends one cam carried by the pivoting of one operating member by movement of the armature of one switch out of the open position to block the other cam thereby preventing movement of the armature of the other electromagnetic switch cut of the open position.

13. The combination of claim 12 wherein said cams are ring segment cams having one end adjacent said intersection point and spaced therefrom only by a distance providing clearance for one ring segment cam only to be carried along its arcuate path without interference from the other ring segment cam.

14. The combination of claim 13 including first and second electrical interlock switches and auxiliary cam means on said first and second operating members which operate said first and second electrical interlock switches, respectively, as said first and second operating members are pivoted by movement of the armatures of said first and second switches between said open and closed positions.

15. In combination;

first and second electromagnetic switches spaced apart and each having an armature movable in spaced apart parallel planes between open and closed positions which open and close said electromagnetic switches;

a first operating member comprising a first pivot member pivoted by movement of the armature of said first switch between said open and closed positions, a second pivot member spaced from said first pivot member and a connecting member connecting the second pivot member to the first pivot member for pivoting said second pivot member with movement of said first armature of said first switch between said open and closed positions;

a second operating member pivoted by movement of the armature of said second switch between said open and closed positions;

a first cam on said second pivot member of said first operating member and carried by said first pivot member along a first arcuate path;

a second cam on said second operating member and carried by second operating member along a second arcuate path; and means mounting said first pivot member of such first operating member and said second operating member in confronting relation with said first and second arcuate paths being coplanar and intersecting at an intersection point through which neither cam extends when both electromagnetic switches are open, and through which one cam carried by the pivoting of one operating member by movement of the armature of one switch out of the open position extends to block the other cam, thereby preventing movement of the armature of the other electromagnetic switch out of the open position.

16. The combination of claim 15 wherein said cams are ring segment cams having one end adjacent said intersection point and spaced therefrom only by a distance providing clearance for one ring segment cam only to be carried along its arcuate path without interference from the other ring segment cam.

17. The combination of claim 16, including a first housing in which the first pivot member of the first operating member is pivotably mounted, and a second housing in which said second operating member and the second pivot member of the first operating member are pivotably mounted, said connecting member extending between said first and second housings.

18. The combination of claim 16, including first and second electrical interlock switches and auxiliary cam means on said first and second operating members which operate said first and second electrical interlock switches, respectively, as said first and second operating members are pivoted by movement of the armatures of said first and second switches between said open and closed positions.

* * * * *